US006305370B1

(12) United States Patent
Rosert et al.

(10) Patent No.: US 6,305,370 B1
(45) Date of Patent: Oct. 23, 2001

(54) VOICE TRANSMITTER FOR A BREATHING PROTECTIVE MASK

(75) Inventors: Michael Rosert; Manfred Gdulla, both of Lübeck (DE)

(73) Assignee: Dräger Sicherheitstechnik GmbH, Lübeck (DE)

( * ) Notice: Subject to any disclaimer, the term of this patent is extended or adjusted under 35 U.S.C. 154(b) by 0 days.

(21) Appl. No.: 09/411,241

(22) Filed: Oct. 4, 1999

(30) Foreign Application Priority Data

Oct. 2, 1998 (DE) ..... 198 45 572

(51) Int. Cl.[7] ..... A62B 18/08
(52) U.S. Cl. ..... 128/201.19; 128/205.25
(58) Field of Search ..... 128/201.19, 205.25

(56) References Cited

U.S. PATENT DOCUMENTS 1,730,227 * 10/1929 McBride ..... 128/201.19
1,762,695 * 6/1930 Monro ..... 128/201.19
2,326,650 * 8/1943 Husted ..... 128/201.19
2,974,665 * 3/1961 Motsinger ..... 128/201.19
3,109,425 * 11/1963 Gongoll et al. ..... 128/201.19
3,124,130 * 3/1964 Klinger ..... 128/201.19
3,140,754 * 7/1964 Motsinger ..... 128/201.19
3,348,537 * 10/1967 Miller et al. ..... 128/201.19
3,572,332 * 3/1971 Wise ..... 128/201.19
3,602,219 * 8/1971 Warncke ..... 128/201.19
4,402,316 * 9/1983 Gadberry ..... 128/201.19
4,756,308 * 7/1988 Ryback ..... 128/201.19
4,926,398 * 5/1990 Fincher ..... 128/201.19
4,961,420 * 10/1990 Cappa et al. ..... 128/201.19

* cited by examiner

*Primary Examiner*—Aaron J. Lewis
(74) *Attorney, Agent, or Firm*—Walter Ottesen

(57) ABSTRACT

The invention is directed to a voice transmitter for a breathing protective mask. The voice transmitter includes a membrane housing (2) and a clamping ring (3) which can be connected to the membrane housing (2). The voice transmitter also includes a voice membrane (4) between the membrane housing (2) and the clamping ring (3). The voice membrane (4) has an outer membrane portion (14) which is accommodated at a connecting location between the clamping ring (3) and the membrane housing (2). An inner portion (15) of the membrane (4) is tensioned over an annularly-shaped projection (8) located on the membrane housing (2). The pretensioning of the voice membrane is adjusted in a simple manner in that the clamping ring (3) has an annularly-shaped support surface 13 for the inner membrane portion (15) and that the connecting location is configured as a threaded connection (7, 10).

9 Claims, 1 Drawing Sheet

VOICE TRANSMITTER FOR A BREATHING PROTECTIVE MASK

BACKGROUND OF THE INVENTION

A voice transmitter for a breathing protective mask is disclosed in European patent publication 0,413,861. The voice transmitter disclosed in this publication includes two housing components between which a voice membrane is clamped. The pretensioning of the voice membrane is necessary for a good voice transmission and is achieved with interengaging cylindrical and inclined surfaces. The two housing components are held together by a snap mechanism. The known voice transmitter can be assembled in a simple manner but it is no longer possible to subsequently change the voice membrane tension. This causes a large range of variation of the voice transmitting characteristics.

SUMMARY OF THE INVENTION

It is an object of the invention to provide a voice transmitter of the kind referred to above which is improved in that the pretensioning of the voice membrane can be adjusted in a simple manner.

The voice transmitter of the invention is for a breathing protective mask and includes: a housing having a base wall and an annular wall extending upwardly from the base wall; the annular wall defining a longitudinal axis and the base wall having an annular projection formed thereon and projecting upwardly from the base wall so as to be concentric with the annular wall; a clamping ring having a lower end facing toward the base wall and having an annular support surface formed on the lower end so as to be interdigitated with respect to the annular projection when the clamping ring is in the housing; the annular wall of the housing and the clamping ring conjointly defining a threaded interface permitting the clamping ring to be moved along the longitudinal axis toward and away from the base wall when the clamping ring is rotated in the threaded interface about the longitudinal axis; and, a voice transmitting membrane subdivided into an annular outer portion fixedly clamped in the threaded interface and an inner portion spanned over the support surface transversely to the longitudinal axis and in pressing contact engagement with the annular projection so as to permit adjusting the membrane in tension as the clamping ring is moved along the longitudinal axis.

The advantage of the invention is essentially that a pretensioning change can be achieved via the depth to which the clamping ring is threadably engaged in the membrane housing. This is achieved by tensioning the voice transmitting membrane on a clamping ring having an outer thread and screwing the clamping ring with the membrane into the membrane housing. The membrane housing is provided on the housing base with an annularly-shaped projection in order to provide a defined support surface for the voice transmitting membrane. The voice transmitting membrane is clamped via this annularly-shaped projection. The diameter of the projection and the clear distance of the support surface of the voice transmitting membrane on the clamping ring are so dimensioned that the voice transmitting membrane is not sheared off in the boundary region between the support surface and the projection.

With the voice transmitter according to the invention, it is also possible to first coarsely adjust the pretension of the voice membrane and then, after a tempering operation wherein the voice membrane is artificially aged, to adjust the tension to the final value. Plastic foils (for example, made of polypropylene) are suitable as voice membranes.

BRIEF DESCRIPTION OF THE DRAWINGS

The invention will now be described with reference to the single FIGURE (FIG. 1) of the drawing which shows a side elevation view, in section, of a voice transmitter according to an embodiment of the invention.

DESCRIPTION OF THE PREFERRED EMBODIMENTS OF THE INVENTION

Figure 1:
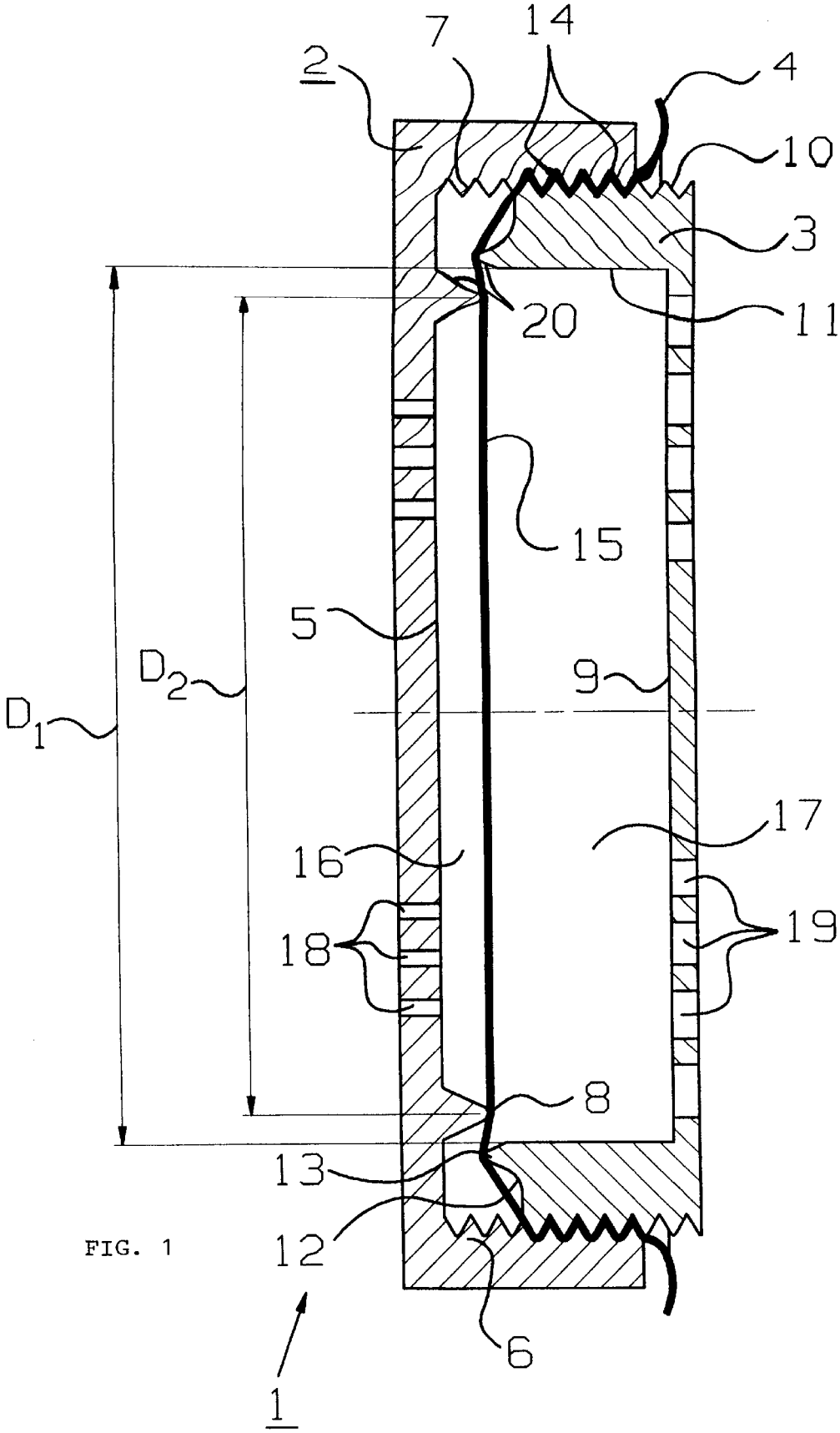

FIG. 1 shows a voice transmitter 1 for a breathing protective mask (not shown). The voice transmitter 1 includes a membrane housing 2, a clamping ring 3 and a voice membrane 4 of polypropylene. The voice membrane 4 is clamped between the membrane housing 2 and the clamping ring 3. The membrane housing 2 is configured to have a pot-like shape and has a housing base wall 5 and a cylindrical wall 6 having an internal thread 7. An annularly-shaped projection 8, which projects into the interior space of the membrane housing 2, is provided on the housing base 5. The voice membrane 4 is clamped utilizing the projection 8. The clamping ring 3 is likewise configured so as to have a pot-like shape and has an essentially planar clamping ring base 9 and a cylindrical wall 11 provided with an external thread 10. An end face 12 of the wall region 11 faces away from the clamping ring base 9 and is configured as an annular continuous rise 13 and defines a support surface for the voice membrane 4. The inner thread 6, the outer thread 10 and the material thickness of the voice membrane 4 are so dimensioned that an external membrane portion 14 of the voice membrane 4 can be clamped between the outer thread 10 and the inner thread 6; whereas, an inner membrane portion 15 of the voice membrane 4 is held between the projection 8 and the rise 13 under pretension. A first membrane chamber 16 is defined between the housing base 5, the projection 8 and the inner membrane portion 15; whereas, the clamping ring base 9, the wall region 11 and the inner membrane portion 15 conjointly define a second membrane chamber 17.

The inner portion 15 of the membrane is then the partition wall between the first membrane chamber 16 and the second membrane chamber 17. The membrane chambers (16, 17) make possible a clear uninterrupted deflection of the voice membrane 4. The housing base 5 and the clamping ring base 9 are provided with openings (18, 19) so that the sound waves, which are transmitted by the voice membrane 4, can be propagated into the ambient.

The assembly of the voice transmitter 1 will now be described.

First, the voice membrane 4 is placed over the rise 13 and the outer thread 10 of the clamping ring 3 so that the voice membrane 4 lies tight on the rise 13. The diameter of the voice membrane 4 is so dimensioned that the voice membrane 4 completely covers the outer thread 10. Thereafter, the clamping ring 3 together with the voice membrane 4 is threadably engaged in the inner thread 7 of the membrane housing 2. The outer membrane portion 14 of the voice membrane 4 is disposed in the overlapping region between the inner thread 7 and the outer thread 10 and is fixed in its position by the threaded connection. The clamping ring 3 is screwed into the membrane housing 2 until the inner membrane portion 15 of the voice membrane 4 touches the projection 8. The clear diameter $D_1$ of the wall region 11 and the diameter of the rise 13 and the diameter $D_2$ of the projection 8 are so dimensioned that the diameter $D_2$ is sufficiently less than the diameter $D_1$ so that the voice membrane 4 is not sheared off between the flanks 20 of the projection 8 and the rise 13 and so that the projection 8 and the rise 13 are interdigitally arranged with respect to each other in the form of concentric rings.

A further rotation of the clamping ring 3 into the membrane housing 2 can continuously adjust the pretensioning of the inner membrane portion 15. With this adjustment, optimal voice transmission characteristics can be achieved with the voice transmitter according to the invention.

It is understood that the foregoing description is that of the preferred embodiments of the invention and that various changes and modifications may be made thereto without departing from the spirit and scope of the invention as defined in the appended claims.

What is claimed is:

1. A voice transmitter for a breathing protective mask, the voice transmitter comprising:

a housing having a base wall and an annular wall extending upwardly from said base wall;

said annular wall defining a longitudinal axis and said base wall having an annular projection formed thereon and projecting upwardly from said base wall so as to be concentric with said annular wall;

a clamping ring having a lower end facing toward said base wall and having an annular support surface formed as a ring-shaped rise on said lower end so as to be interdigitated with respect to said annular projection when said clamping ring is in said housing;

said annular projection and said ring-shaped rise having respective flanks which are mutually adjacent;

said annular wall of said housing and said clamping ring conjointly defining a threaded interface permitting said clamping ring to be moved along said longitudinal axis toward and away from said base wall when said clamping ring is rotated in said threaded interface about said longitudinal axis;

a voice transmitting membrane subdivided into an annular outer portion fixedly clamped in said threaded interface and an inner portion spanned over said rise transversely to said longitudinal axis and in pressing contact engagement with said annular projection so as to permit adjusting said membrane in tension as said clamping ring is moved along said longitudinal axis; and, said ring-shaped rise having a first diameter ($D_1$) and said annular projection having a second diameter ($D_2$) less than said first diameter ($D_1$) by an amount sufficient to ensure that said voice transmitting membrane is not sheared off between said mutually adjacent flanks when said tension of said membrane is adjusted.

2. The voice transmitter of claim 1, wherein said base wall and said lower end of said clamping ring conjointly define a clear spacing therebetween interrupted only by said inner portion of said membrane.

3. The voice transmitter of claim 1, wherein said voice transmitter consists only of said voice transmitter membrane, said housing and said clamping ring.

4. The voice transmitter of claim 1, wherein said clamping ring has an annular projection formed on said lower end to define said annular support surface; said annular projection of said housing is an integral homogeneous part of said housing and said annular projection of said clamping ring is an integral homogeneous part of said clamping ring.

5. The voice transmitter of claim 1, wherein said voice transmitting membrane has a diameter dimensioned so as to cause said outer portion thereof to completely cover said threaded interface.

6. The voice transmitter of claim 1, wherein said housing is a mug-shaped housing and said annular wall is a cylindrical wall; and, said threaded interface including an inner thread formed on said cylindrical wall.

7. The voice transmitter of claim 6, wherein said clamping ring has a mug-shaped configuration; and, said threaded interface includes an outer thread formed on said clamping ring for threadably engaging said inner thread.

8. The voice transmitter of claim 7, wherein said housing and said clamping ring are threadably engaged so that said housing and said voice transmitting membrane conjointly define a first membrane chamber and so that said clamping ring and said voice transmitting membrane conjointly define a second membrane chamber; and, said voice transmitting membrane defining a partition wall between said first and second membrane chambers.

9. The voice transmitter of claim 1, wherein said ring-shaped rise and said annular projection define respective free standing tips pointing in mutually opposite directions and in contact engagement only with said voice transmitting membrane.

* * * * *